US007272940B2

(12) United States Patent
Vinberg

(10) Patent No.: US 7,272,940 B2
(45) Date of Patent: Sep. 25, 2007

(54) SUBMERSION TANK FOR ON-BOARD FISH FREEZING

(76) Inventor: Donald J. Vinberg, 3127 Mylark Extension, Kodiak, AK (US) 99615

( * ) Notice: Subject to any disclaimer, the term of this patent is extended or adjusted under 35 U.S.C. 154(b) by 18 days.

(21) Appl. No.: 11/153,522

(22) Filed: Jun. 14, 2005

(65) Prior Publication Data

US 2005/0279107 A1 Dec. 22, 2005

Related U.S. Application Data

(60) Provisional application No. 60/579,716, filed on Jun. 14, 2004.

(51) Int. Cl.
*F25D 17/02* (2006.01)

(52) U.S. Cl. ..... 62/64; 62/434

(58) Field of Classification Search ..... 62/64, 62/240, 434; 426/643, 524
See application file for complete search history.

(56) References Cited

U.S. PATENT DOCUMENTS

| | | | | |
|---|---|---|---|---|
| 1,547,258 | A | 7/1925 | Newton | |
| 1,773,080 | A | 8/1930 | Birdseye | |
| 1,791,023 | A | 2/1931 | Dahl et al. | |
| 1,827,856 | A | 10/1931 | Pope | |
| 1,887,463 | A | 11/1932 | Ogura | |
| 2,377,693 | A | 6/1945 | Johnston | |
| 2,413,918 | A | 1/1947 | Harris | |
| 2,501,655 | A | 3/1950 | Altenburg | |
| 2,722,036 | A | 11/1955 | Servidio | |
| 2,746,272 | A | 5/1956 | Carpenter | |
| 2,909,040 | A | 10/1959 | Newell | |
| 3,261,176 | A | 7/1966 | Puretic | |
| 3,435,630 | A | 4/1969 | Ferry | |
| 3,453,684 | A | 7/1969 | Heck | |
| 3,696,631 | A | 10/1972 | Valdes | |
| 3,717,123 | A * | 2/1973 | Regnier | 119/203 |
| 3,727,579 | A | 4/1973 | Lee | |
| 3,802,214 | A | 4/1974 | Prieto | |
| 4,051,690 | A | 10/1977 | Doust | |
| 4,191,027 | A | 3/1980 | Inoue | |
| 4,270,598 | A | 6/1981 | Britton | |

(Continued)

FOREIGN PATENT DOCUMENTS

JP 61-119136 A 6/1986

(Continued)

OTHER PUBLICATIONS

Harada, H., Production of Fish Frozen With Brine Utilizing Squalane, Patent Abstracts of Japan, Application No. 59240568, Publication No. 61119136A; Publication Date: Jun. 6, 1986.

(Continued)

*Primary Examiner*—Melvin Jones
(74) *Attorney, Agent, or Firm*—R. Reams Goodloe, Jr.

(57) ABSTRACT

A submersion tank for on-board brine freezing of whole or nearly whole fish, and a method for freezing fish employing such tank. One or more pivotable screen baskets are provided in tank containing refrigerated brine. The pivotable screen baskets are provided in a normal, fish receiving position immersed in refrigerated brine. Once fish are frozen, the pivotable screen baskets are pivoted upward to a fish unloading position for delivery of frozen fish for bagging and storage.

33 Claims, 11 Drawing Sheets

U.S. PATENT DOCUMENTS

| | | | | |
|---|---|---|---|---|
| 4,555,908 | A | | 12/1985 | Peterson |
| 4,829,698 | A | | 5/1989 | McDonald |
| 5,010,681 | A | | 4/1991 | Cox, Jr. |
| 5,050,526 | A | | 9/1991 | Nelson et al. |
| 5,222,367 | A | * | 6/1993 | Yamada ..... 62/64 |
| 5,761,913 | A | | 6/1998 | Liberman et al. |
| 5,797,271 | A | | 8/1998 | Darigo et al. |
| 6,080,330 | A | | 6/2000 | Bloomer |
| 6,119,476 | A | | 9/2000 | Slaughter et al. |
| 6,183,356 | B1 | | 2/2001 | Middleton et al. |
| 6,299,793 | B1 | | 10/2001 | Hartley et al. |
| 6,315,919 | B1 | | 11/2001 | Sapienza |
| 6,398,979 | B2 | | 6/2002 | Koefod et al. |
| 6,416,648 | B1 | | 7/2002 | Park |
| 6,436,310 | B1 | | 8/2002 | Hartley et al. |
| 6,440,325 | B1 | | 8/2002 | Hartley et al. |
| 6,468,442 | B2 | | 10/2002 | Bytnar |
| 6,506,318 | B1 | | 1/2003 | Sapienza et al. |
| 6,544,434 | B2 | | 4/2003 | Sapienza |
| 6,582,622 | B1 | | 6/2003 | Hartley et al. |
| 7,048,961 | B2 | | 5/2006 | Knauf |
| 2005/0279107 | A1 | | 12/2005 | Vinberg |

FOREIGN PATENT DOCUMENTS

| | | | |
|---|---|---|---|
| JP | 61-219334 | A | 9/1986 |
| JP | 62-138134 | A | 6/1987 |
| WO | WO 2004/112490 | A2 | 12/2004 |
| WO | WO 2004/112490 | A3 | 12/2004 |
| WO | WO 2005/021732 | A2 | 3/2005 |
| WO | WO 2005/021732 | A3 | 3/2005 |

OTHER PUBLICATIONS

Hayashi, T., Apparatus for cooling and Storage of Fish and Shellfish, Patent Abstracts of Japan; Application No. 60062713, Publication No. 61219334A; Publication Date: Sep. 29, 1986.

Hayashi, T., Direct Dipping and Refrigeration of Large-Sized Fish Body in Calcium Chloride Brine and Apparatus Therefor, Patent Abstracts of Japan; Application No. 60280106, Publication No. 62138134A; Publication Date: Jun. 20, 1987.

Almy, L.YH. and Field, E., The Preservation of Fish Frozen in Chilled Brine. I-The Penetration of Salt, The Journal of Industrial and Engineering Chemistry, Oct. 1921, pp. 927-930.

Almy, L.YH. and Field, E., The Preservation of Fish Frozen in Chilled Brine. II-The Keeping Quality of the Fish, The Journal of Industrial and Engineering Chemistry, Mar. 1922, pp. 203-206.

Tressker, Donald K. Chemical Problems of Quick-Freezing Industry, The Journal of Industrial and Engineering Chemistry, vol. 24, No. 6, pp. 682-686.

Braker, M., Handling Sportcaught Fish, Oregon State University Extension Service, EC 1414, Oct. 1992 (2 pages).

* cited by examiner

SUBMERSION TANK FOR ON-BOARD FISH FREEZING

RELATED PATENT APPLICATIONS

This application claims priority from prior U.S. Provisional Patent Application Ser. No. 60/579,716, filed on Jun. 14, 2004. The disclosure of the above identified patent application is incorporated herein in its entirety by this reference, including the specification, drawing, and claims of such application.

COPYRIGHT RIGHTS IN THE DRAWING

A portion of the disclosure of this patent document contains material that is subject to copyright protection. The applicant no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to the field of freezing food items, and more particularly, to apparatus suitable for freezing fish on-board fishing vessels.

BACKGROUND

Freezing of fish on-board fishing vessels has been attempted or practiced in one fashion or another for many years. However, the fresh freezing of fish immediately after catching the same, as heretofore practiced, has not resulted in widespread demand for whole fish preserved via such practices, primarily because apparatus and methods heretofore taught have not resulted in easy and quick handling of fish in a manner that yields high quality whole frozen fish products for later thaw and reuse.

Thus, it would be a distinct and important improvement to provide an apparatus for the quick freezing of freshly caught whole fish that would minimize the time required for handling, and which would enable high quality whole fish to be provided for cold storage, and thus for later marketing and use.

Moreover, it would be desirable to provide an apparatus for fresh on-board freezing apparatus which crew members can easily employ to quickly freeze whole fish. Further it would be advantageous that such an apparatus include features that allow such frozen whole fish to be quickly and easily handled, via easily used on-board equipment. Thus, the advantages of a novel apparatus providing such desirable features which is employable on a fishing vessel to provide a workable whole fish freezing method can be readily appreciated.

BRIEF DESCRIPTION OF THE DRAWING

In order to enable the reader to attain a more complete appreciation of the novel water treatment process disclosed and claimed herein, and the various embodiments thereof, and of the novel features and the advantages thereof over prior art processes, attention is directed to the following detailed description when considered in connection with the accompanying figures of the drawing, wherein:

The foregoing figures, being merely exemplary, contain various elements that may be present or omitted from actual apparatus configurations and various vessel design adaptions and implementations depending upon the circumstances. An attempt has been made to draw the figures in a way that illustrates at least those elements that are significant for an understanding of the various embodiments and aspects of the invention. Optional or alternate features, may be utilized in order to provide efficient, low cost on-board fish freezing equipment which can be implemented in a desired throughput size and physical configuration for providing optimum fish freezing plant operations that assure quality of the product. Various other elements of the submersion tank for on-board brine freezing of fresh whole fish, especially as applied for different variations of the functional components illustrated, may be utilized in order to provide a submersion tank system with pivotable screen and submersion lids as taught herein, in combination with other on-board fish freezing equipment.

DESCRIPTION

Figure 11:
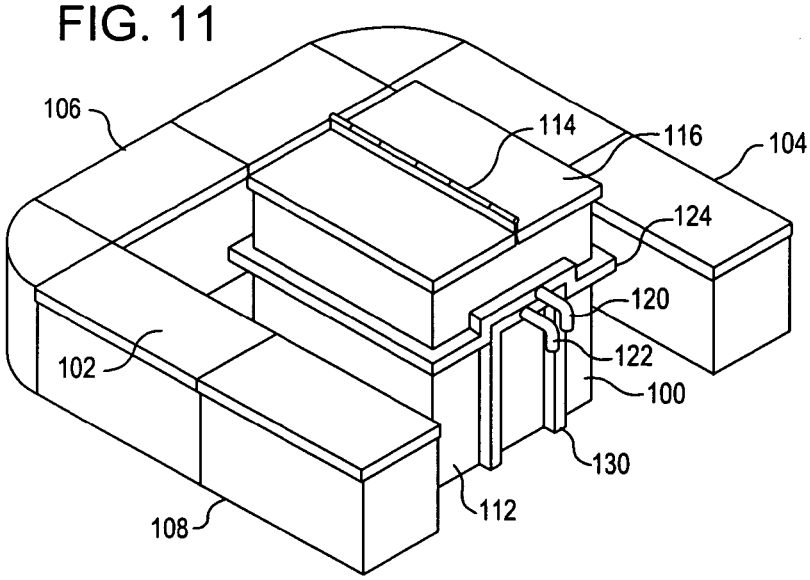
FIG. 11 is a perspective view which shows the location of a submersion tank, and adjacent holding tanks for holding and bleeding freshly caught fish, as well as a tank cover used for covering the submersion tank.
Figure 12:
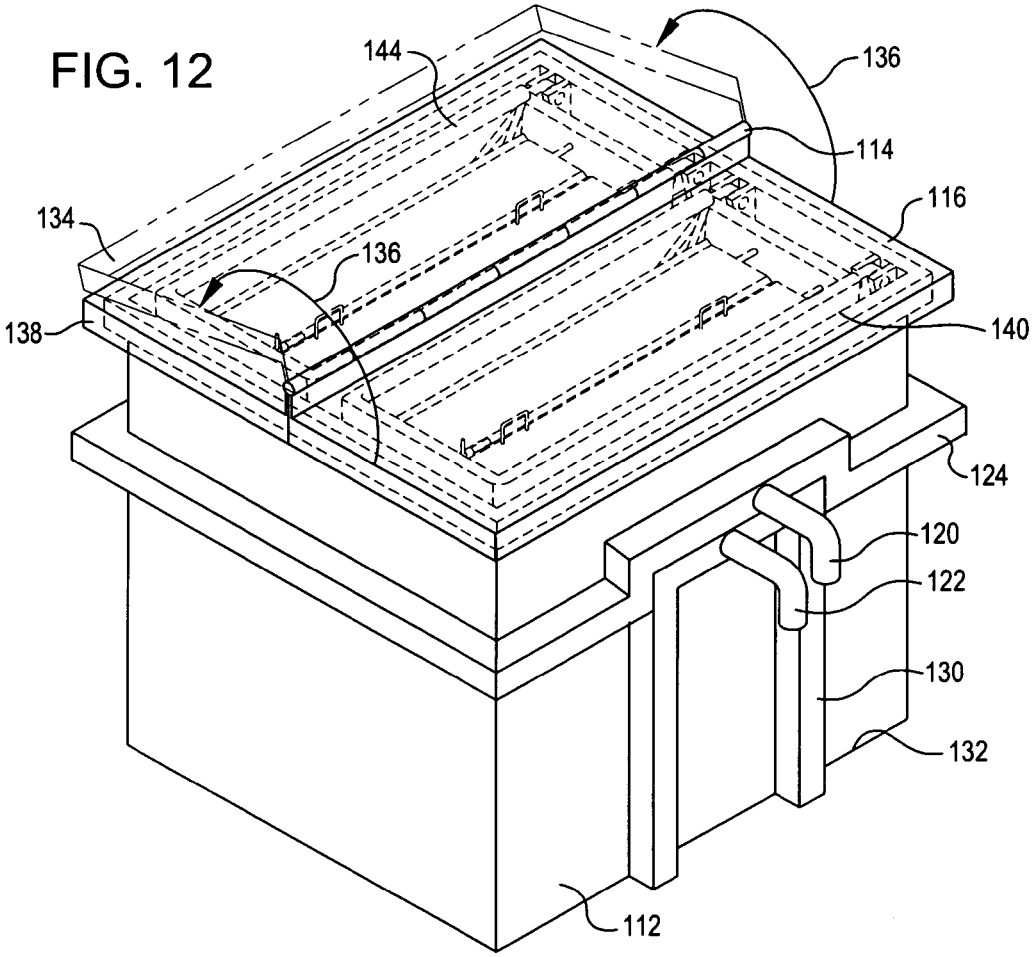
FIG. 12 is a perspective view of a submersion tank for on-board freezing, showing the use of a hinged, insulated tank cover which can be flipped to a partially open position for inserting fish into, or removing fish from, either one of the pivotable caged screen baskets.
Figure 15:
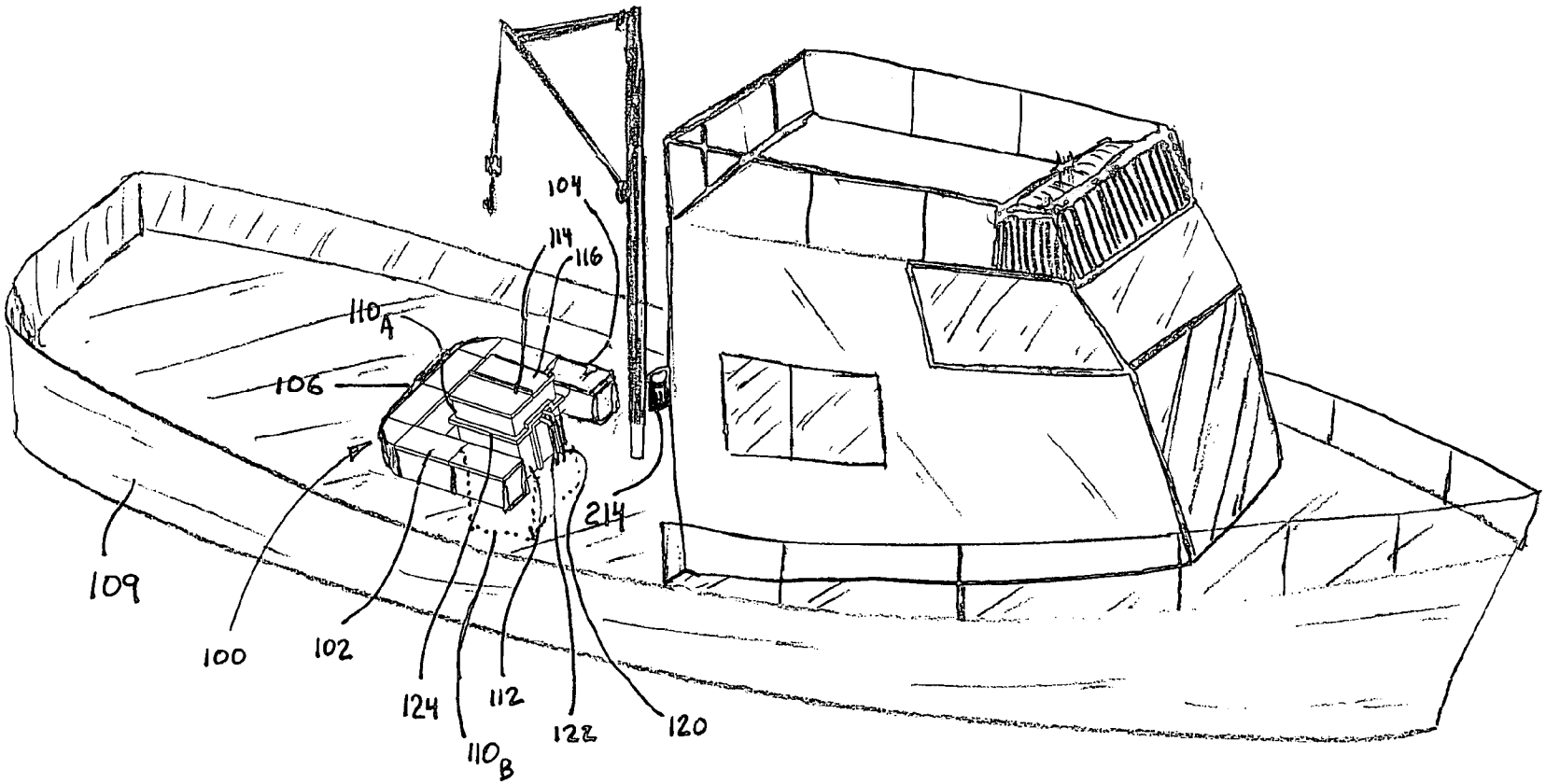
FIG. 15 provides a perspective view of a fishing vessel on which a submersion tank for on-board freezing has been installed.

Turning now to FIG. 12, a perspective view of a submersion tank system 100 is shown. Also, as seen in FIGS. 11 and 15, adjacent to tank system 100 may be provided a generally U-shaped bleed tank system 102 at the port side 104, stern 106, and starboard side 108, respectively, of vessel 109. As shown in FIG. 12, a liquid submersion tank 110 is provided having upwardly extending sidewalls 112. Also, as noted in FIG. 15, an above deck portion $\mathbf{110}_A$ and a below deck portion $\mathbf{110}_B$ may be provided in tank 110. A cover 116 with hinges 114 is provided. A refrigerated liquid brine inlet 120 and refrigerated liquid brine outlet 122 are provided. Inlet or supply headers 124 are visible, and as further explained below, in one embodiment, can be provided about the perimeter of tank 110. Also, the outlet (return) or suction headers 130 are shown, and such outlet headers 130 are in one embodiment, located along the bottom 132 of the tank 110.

A perspective view of a submersion tank system 100 as suitable for placement on board the deck of a fishing vessel is shown in FIG. 12. This illustration shows two positions for one half of the tank cover or lid 116, which has a hinge 114 along center of the lid. In solid lines, cover 116 is shown in place fully covering the liquid container 110, ready to be dogged (clamped) down. In hidden lines, a first portion 134 of the cover is folded back in the direction of reference arrows 136 to rest on top of a second portion 138 of the cover 116, in which position one of the pivotable caged screens 140 and 144 would be upwardly exposed, ready for loading of fish, or for pivoting upward for the unloading of fish 200.

Figure 3:
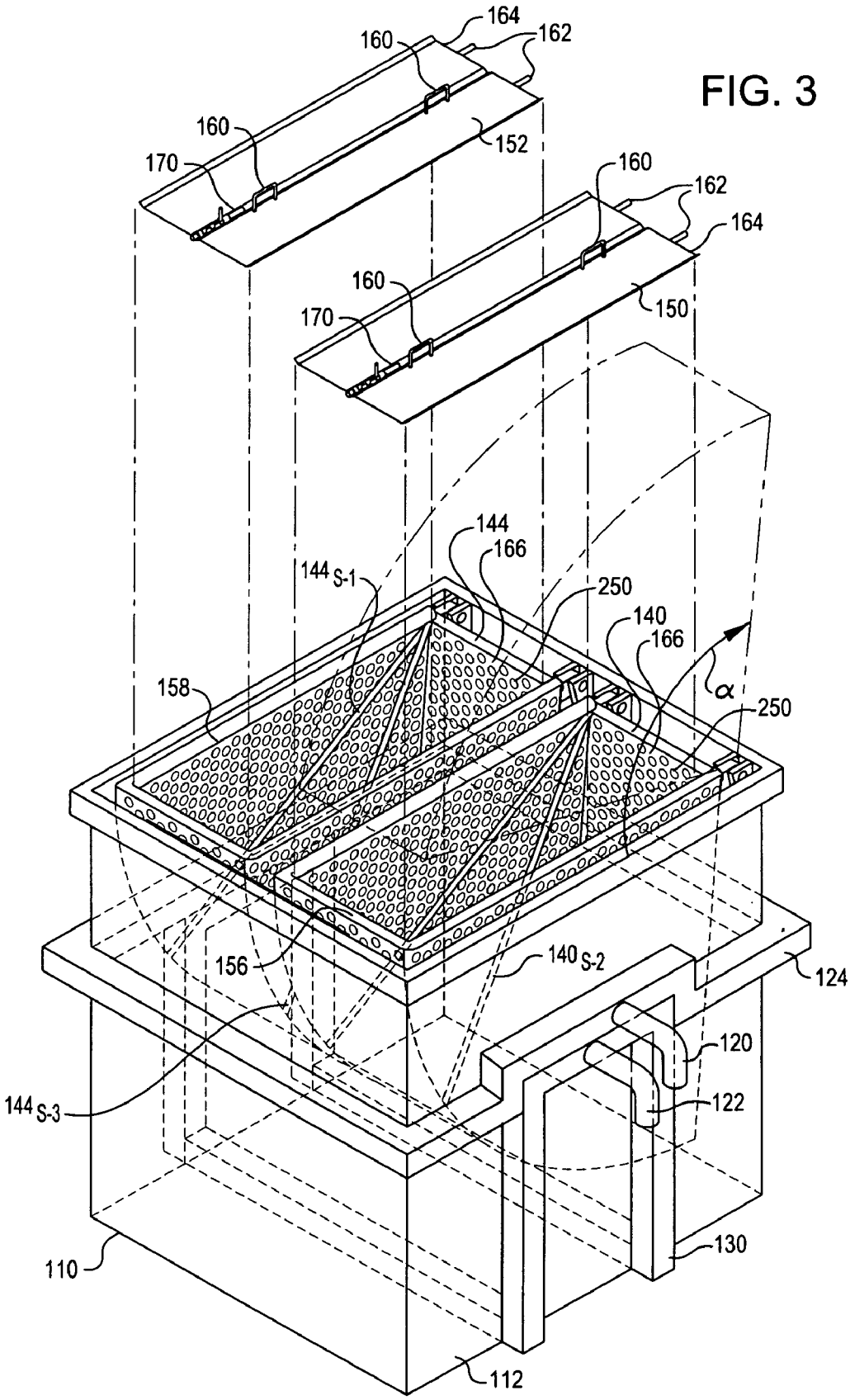
FIG. 3 is another perspective view, now showing pivotable caged screen baskets in their immersed, resting, fish loading position in the submersion tank, showing the screen baskets each pivotally connected at first and second pivot points to the submersion tank sidewall a the upper edge of the sidewall of the submersion tank, as well as showing a pair of submersion lids which are used by crew members to force fish to be frozen downward into the refrigerated brine while the fish are retained by the caged screen basket.

In FIG. 3, both screens 140 and 144 are seen in position for accepting freezing brine and fish. Also, generally rectangular shaped submersion lids 150 and 152 are shown sized and shaped to fit within the upper ends 156 and 158 of screens 140 and 144. Submersion lids 150 and 152 are provided with upwardly extending handles 160 for manual manipulation when pushing fish down into screens 140 and 144. Fixed pins 162 at the pivot end 164 of submersion lids 150 and 152 are provided sized and shaped to fit within apertures 166 in screens 140 and 144. Adjustable locking pins 170 are provided at the distal end of pivotable screens 140 and 144.

Figure 1:
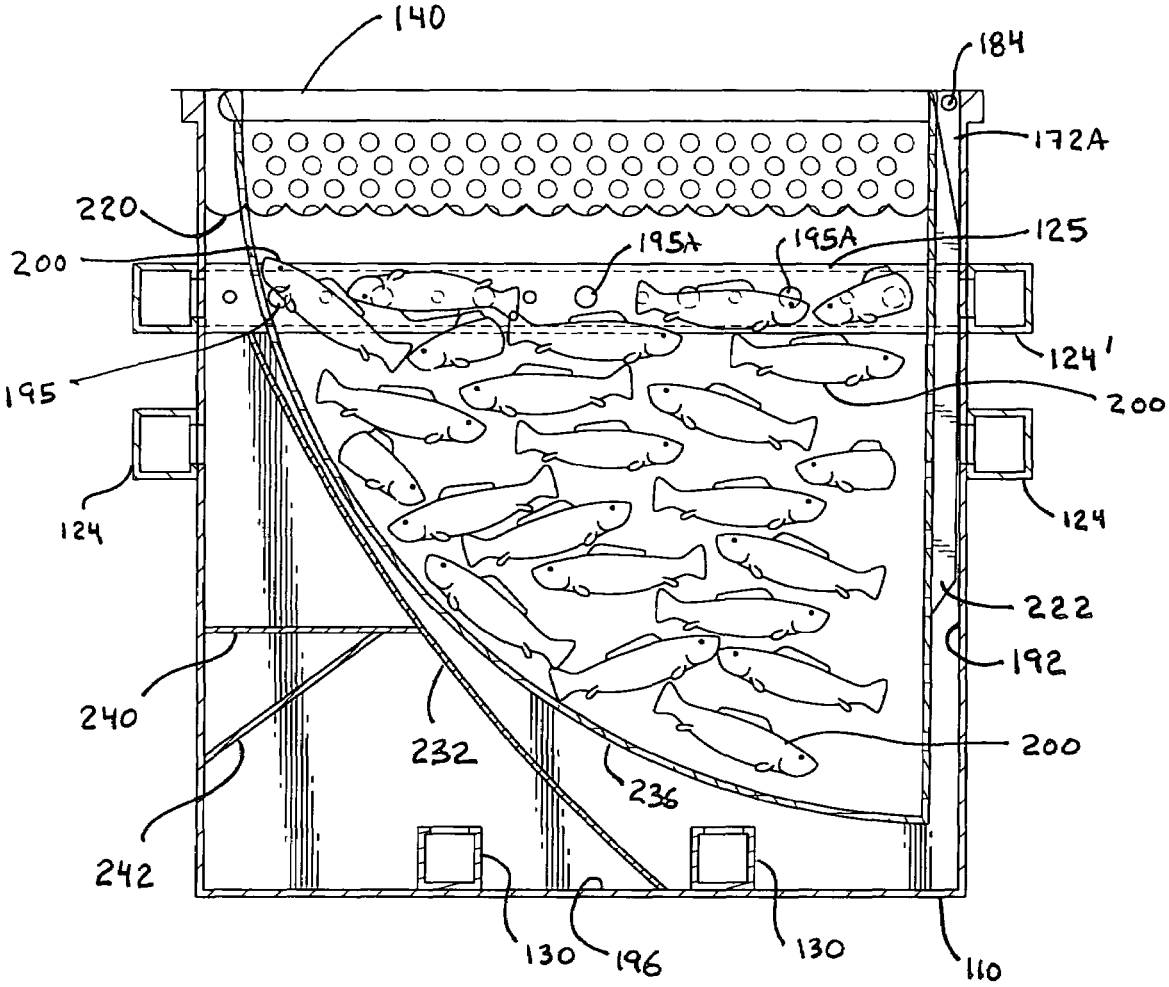
FIG. 1 is a vertical cross-sectional view of a submersion tank with pivotable caged screen basket immersed therein in the normally lowered, fish freezing position, holding a plurality of fish which are being frozen; also shown are refrigerated brine inlet and outlet headers, as well as baffles for directing the refrigerated brine through the caged screen basket.
Figure 2:
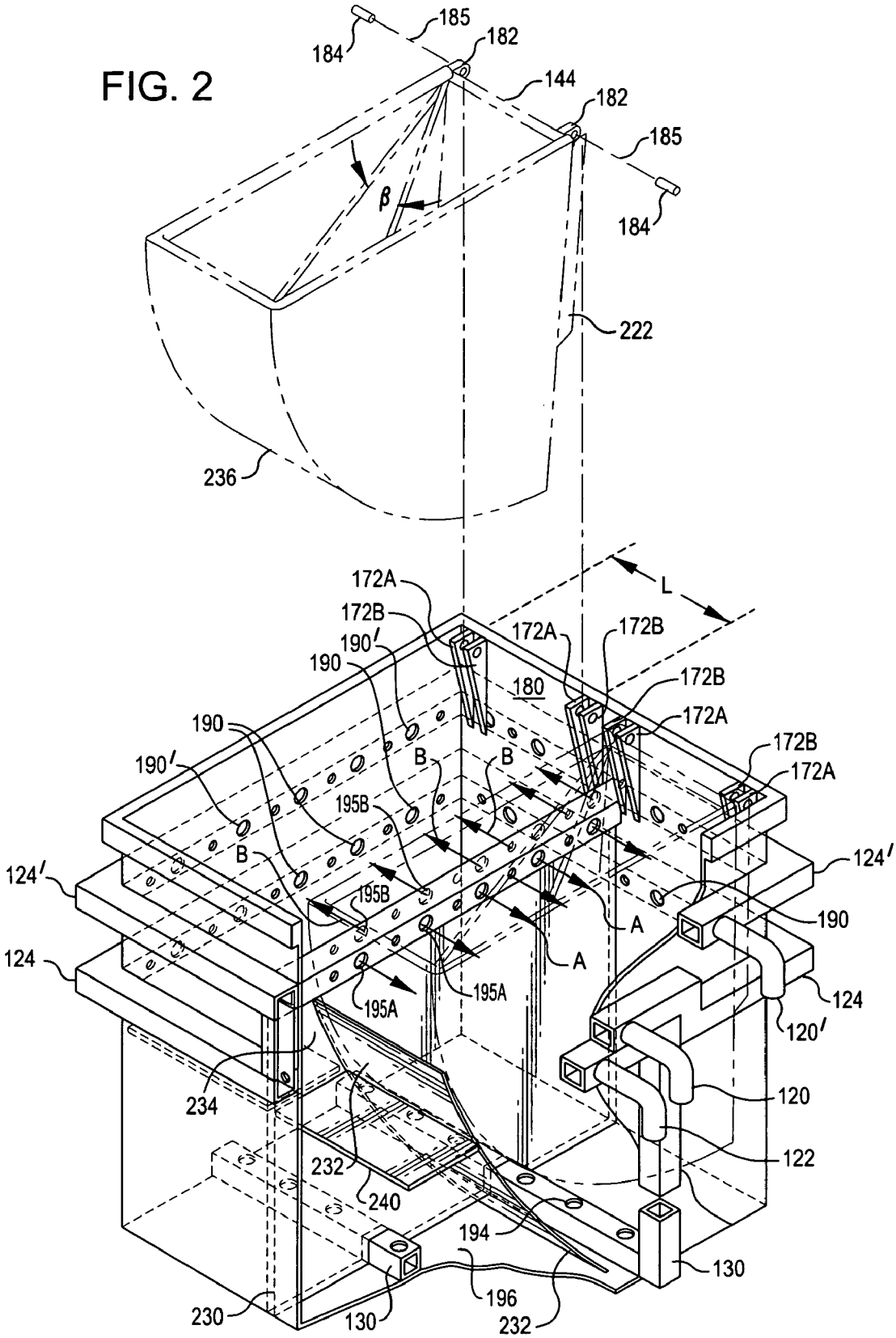
FIG. 2 provides a perspective view of a submersion tank with pivotable caged screen basket, showing in some detail the configuration of pivot supports, refrigerated brine inlet and outlet headers, as well as baffles for directing the refrigerated brine through the caged screen basket.
Figure 4:
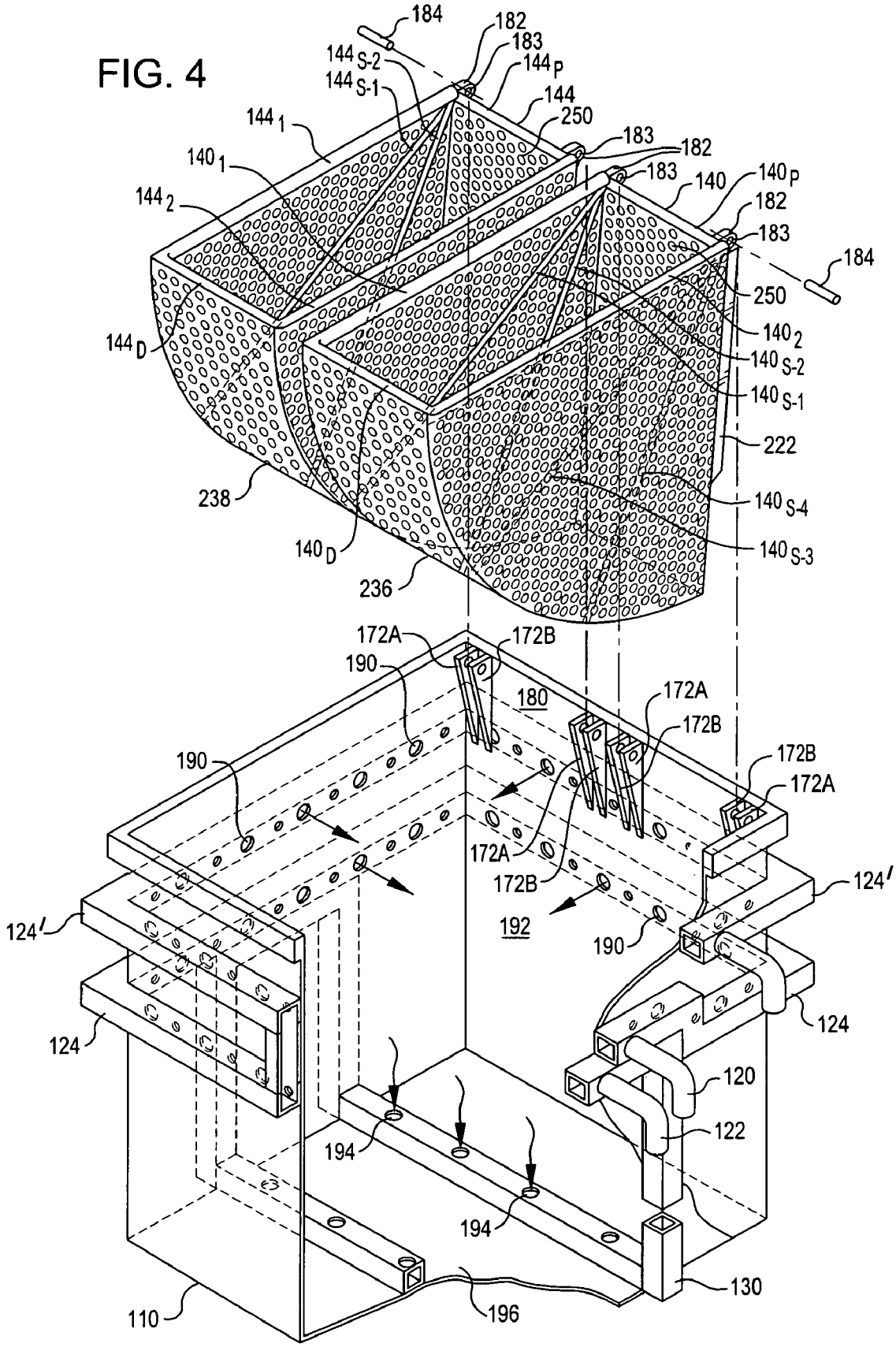
FIG. 4 is a perspective view similar to FIG. 3, now showing the pivotable caged screen baskets as if detached and removed directly upward, to reveal the pivot pins about which they are designed to pivot upward and outward.

As shown in FIG. 4, a pair of pivot supports 172A and 172B (generally triangular in shape in this embodiment) are spaced apart a suitable distance L and fixed to the interior 180 of the upwardly extending tank wall 112 at each end of each of two pivotable screens 140 and 144. Complementary pivot eyes 182 having pivot pin apertures 183 therethrough, are each sized and shaped to pivotably fit between a pair of pivot supports 172A and 172B, are provided spaced apart on each side of the pivot end of the pivotable screens 140 and 144. Pivot pins 184 are used to join pivot supports 172A and 172B and pivot eyes 182 by extending through pivot pin apertures 183. Also seen in this FIG. 4 is one embodiment for a plurality of brine distributor inlets 190 along upper interior sidewalls 192 of the submersion tank 110, and a plurality of brine receiver outlets 194 along the bottom floor 196 of the submersion tank, and the related inlet headers 124 and outlet headers 130 respectively, as well as the corresponding related inlets 120 and outlets 122. As noted in FIGS. 1 and 2, in one embodiment, multiple inlet headers, specifically headers 124 and 124, may be provided. And, as seen in FIGS. 1 and 2, in the case of header 124, a centrally located interior header portion 125 having outlets 195 may be provided running across tank 110 between screen 140 and screen 144, and as shown in FIG. 2, in an orientation transverse to the pivot axis 185 of pivot pins 184. This interior header portion 125 is useful in the embodiment illustrated in FIGS. 1 and 2, wherein both a vertical baffle 230 and an arcuate baffles 232 and 234, roughly approximating (but slightly less than) the curvature of the bottom 236 and 238 of screens 140 and 144, respectively, are utilized, to urge refrigerated brine to directly traverse screens 140 and 144, and thus prevent refrigerated brine from short circuiting or bypassing the fish 200 to be frozen. Vertical baffle 230 may be provided in a generally planar form, such as a parallelepiped shape, which fits between screens 140 and 144. Arcuate baffles 232 and 234 may extend to the bottom 196 of submersion tank 110, and can be supported by internal supports 240 and 242. By use of vertical baffle 230 and arcuate baffles 232 and 234, refrigerated brine flows into screens 140 and 144 via outlets 195A (in the direction of reference arrow A) and 195B (in the direction of reference arrow B), respectively (see FIG. 2), as well as via outlets 190 and/or 190, 50 that the baskets 140 and 144 are filled at the top with refrigerated brine from all four sides. Then, brine must flow toward the bottom of screens 140 and 144, in order for removal from tank 110 via outlets 194.

Figure 6:
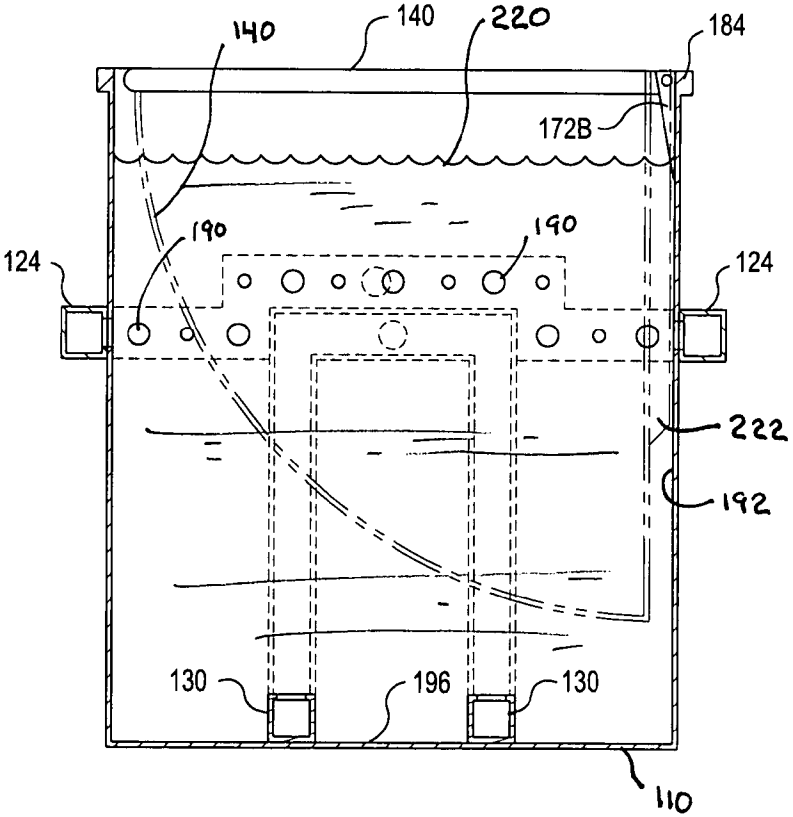
FIG. 6 is a vertical cross-sectional view of a submersion tank, similar to FIG. 5, but at right angles to the view just shown in FIG. 5, but also showing certain details of refrigerated brine inlets and outlets.
Figure 5:
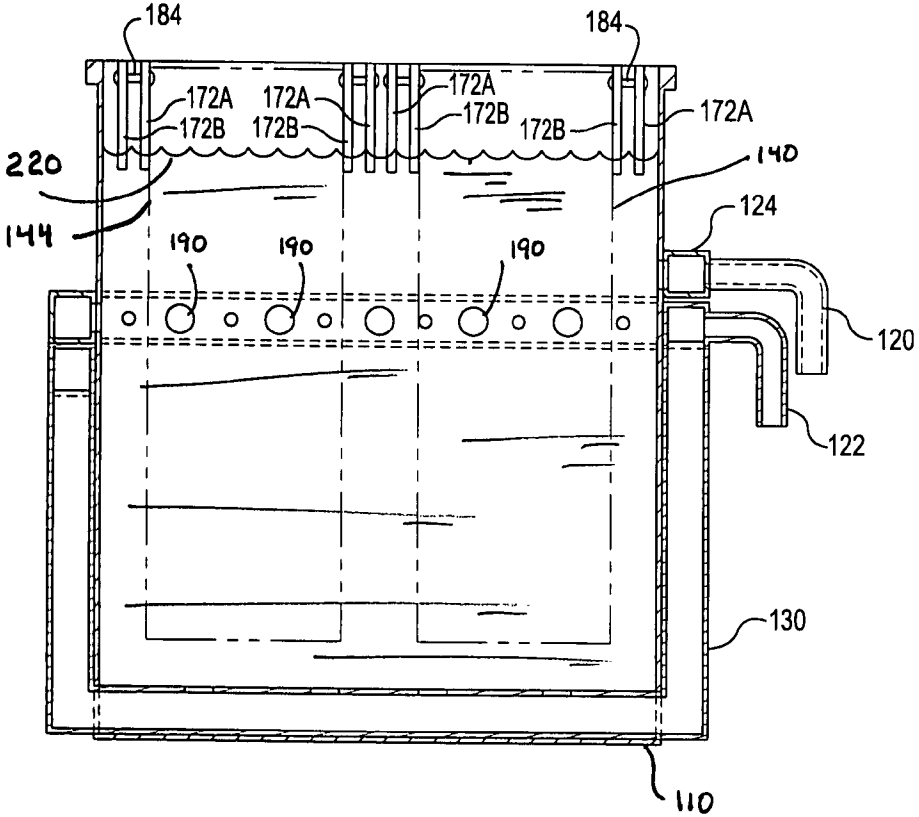
FIG. 5 is a vertical cross-sectional view, showing pivot pins for the pivotable caged screen baskets, as well as details of refrigerated brine inlet and outlet headers.
Figure 8:
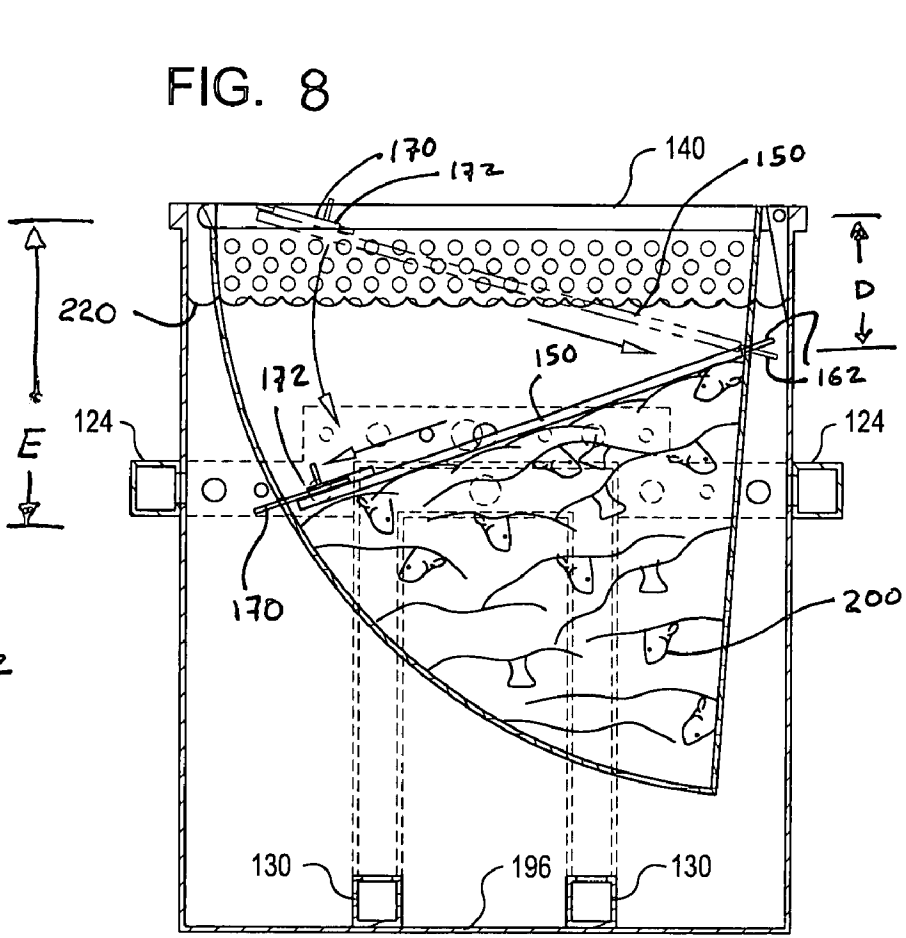
FIG. 8 is a vertical cross-sectional view of a submersion tank showing the tank full of refrigerated brine as also illustrated in FIG. 7 above, but now additionally showing the use of a submersion lid inserted into one end of the pivotable caged screen basket, and pivoted downward along the arcuate portion of the caged screen basket, to push fish, which tend to float up in the refrigerated brine, downward into the refrigerated brine, to assist in freezing of the fish.
Figure 7:
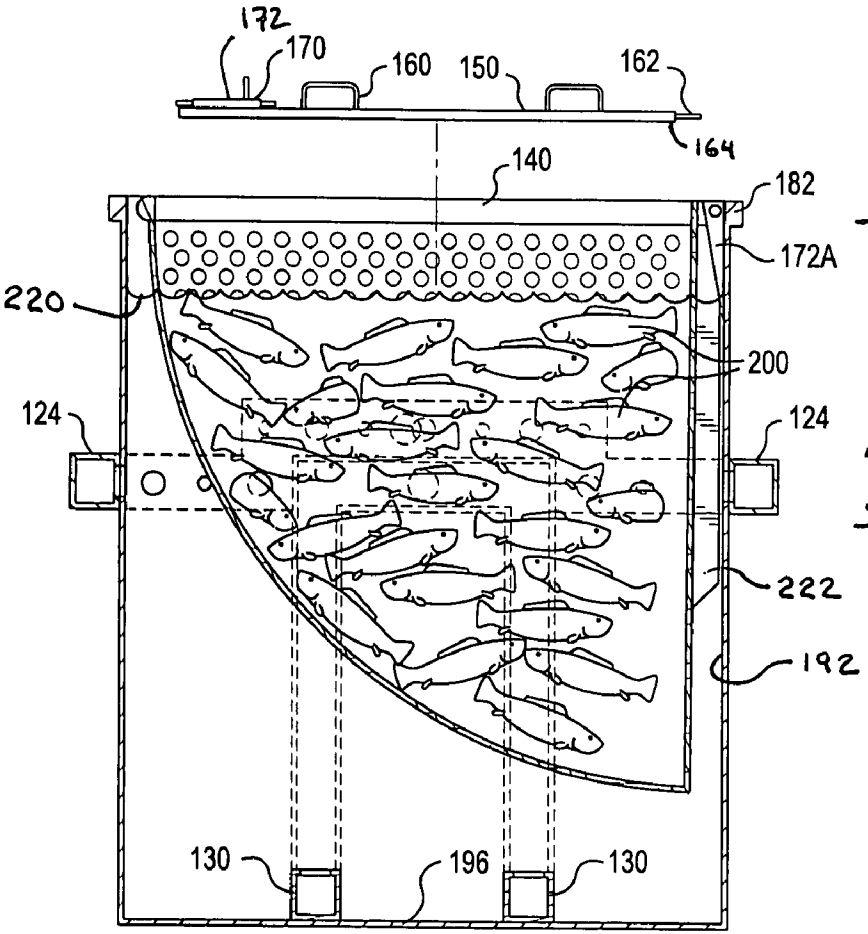
FIG. 7 is a vertical cross-sectional view of a submersion tank, showing the tank full of refrigerated brine, with fresh fish to be frozen contained in a pivotable caged screen basket, and showing a submersion lid above the tank, ready for immersion into the tank for forcing fish down into the refrigerated brine.

FIGS. 5 and 6 show a vertical cross-sectional view, taken from the side and from an end, respectively, of a submersion tank 110 having refrigerated brine 220 therein, ready for accepting fish 200 as seen in FIGS. 7 and 8. Pivotable caged screens 140 and 144 are shown in hidden lines located in their lowered, fish freezing position. As seen in FIG. 7, in one embodiment, when screen 140 is in the lowered, fish freezing position, the screen support portion 222 of screen 140, which may be provided in the form of a length of generally L-shaped channel, rests against the interior sidewall 192 of submersion tank 110, to support screen 140.

Figure 10:
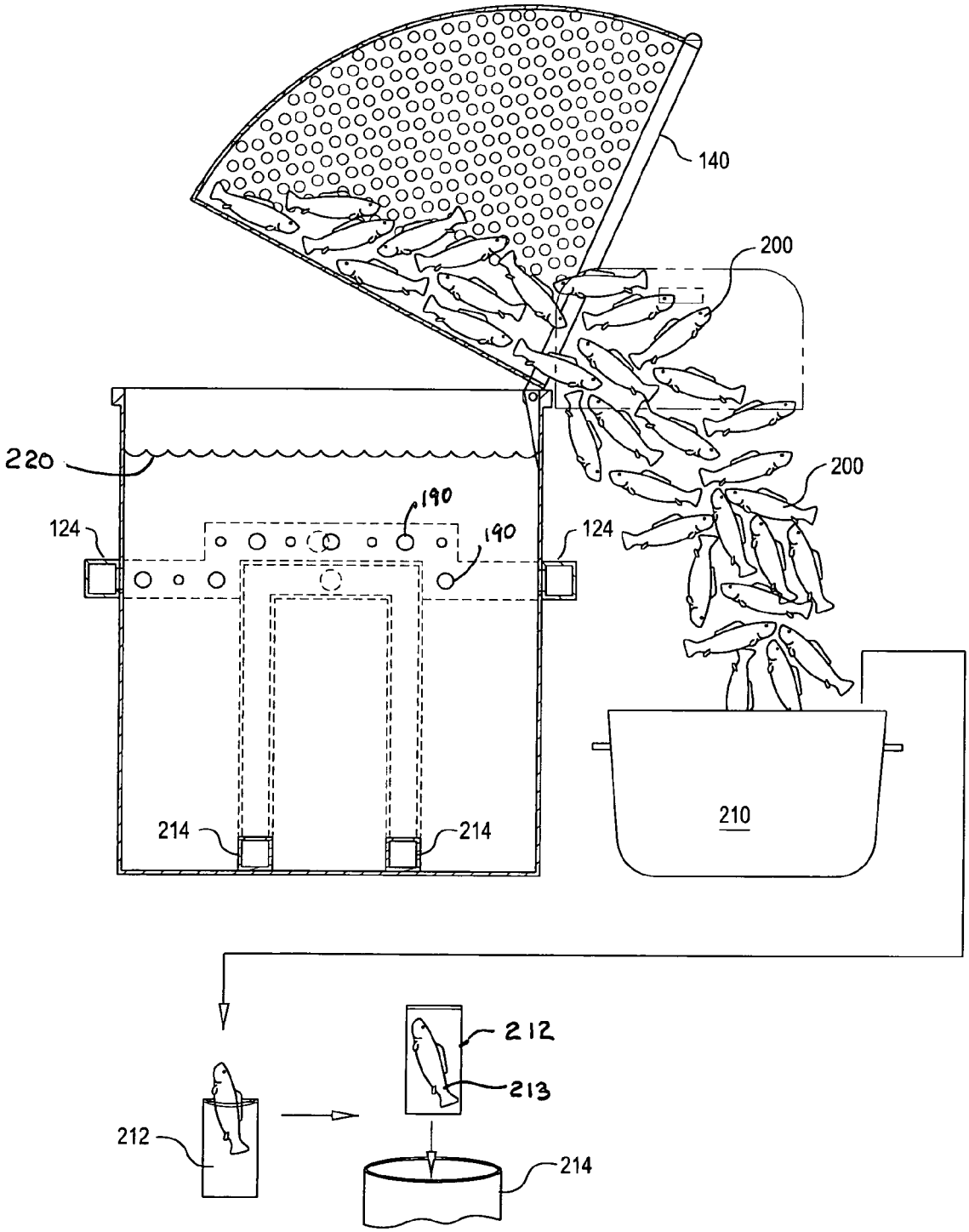
FIG. 10 illustrates the movement of a pivotable caged screen basket to an upward, raised, frozen fish discharging position, wherefrom fish are placed into catch bins; the fish may then be individually wrapped and dropped via a tube or chute into the hold of a fishing vessel for storage. Also clearly seen is the roughly quarter-round shape of the pivotable caged screen basket, which in one embodiment may be generally sized and shaped to contain a quarter round portion along a length of cylindrical space.

FIG. 10 shows the fish 200 just frozen in the pivotable screen 140 being dumped out into a bin 210 when the screen 140 is raised to the upward, fish discharging position. Also shown in FIG. 10 are the subsequent steps, optionally performed in this embodiment, of putting fish 200 in bags 212 and dropping the bagged fish 200 into the fishing vessel's fish hold via chute 214.

FIG. 4 includes a perspective taken looking downward into the pivotable screens 140 and 144, where the distal end portion (away from the pivot) 140D and 144o is shown. In this embodiment, parallel radially extending three inch size half round arms l4O and 1402, and 144 and 1442, which together with the pivot side stiffener l40, and l4Ap, form a generally rectangular screen opening on the upper side of the screens 140 and 144, respectively. This rectangular opening is ready to receive fish 200 when screens 140 and 144 are located in the lowered, fish freezing position. For further strength, nominal three inch size half round stiffeners 140, 140s2 14053 andl4Os4, may be utilized on screen 140 as shown in FIG. 4. Similarly, half round stiffeners 144s-2, l44s-3. (and 144s-4, not shown) may be utilized on screen, In one embodiment, the three inch size half-rounds for stiffening may be located at angularly spaced apart intervals such as at about every thirty degrees. 140s-3 andl4Os-4, may be utilized on screen 140 as shown in FIG. 4. Similarly, half round stiffeners 144s-2, l44s-3. (and 144s-4, not shown) may be utilized on screen, In one embodiment, the three inch size half-rounds for stiffening may be located at angularly spaced part intervals such as at about every thirty degrees.

As variously illustrated in FIGS. 3, 7, 8, and 9, a manual submersion lid 150 can be utilized by fishermen to push 200 fish downward into the refrigerated brine 200. As noted in FIG. 9, a plurality of fixed pins 162 are provided at pivot end 164 of the submersion lid 150. The pins 162 are sized and shaped for being secured within one of the apertures 250 in the screens 140 and 144, so as to enable the submersion lids 150 to be held a desired distance D downward from the top or pivot plane of the screens 140 and 144, when the screens 140 and 144 are in the lowered, fish freezing position. On other end, normally the starboard or distal end of the submersion lid 150, a manually releasable locking pin 170 and latch 172 is provided, sized and shaped for being releasably secureable by one of the apertures 250 in the screen 140 or 144, so as to hold the submersion lid 150 at a desired distance E downward from the top or pivot plane of the screens 140 and 144, when the screens 140 and 144 are in the lowered, fish freezing position.

In FIG. 8, it can be seen how the submersion lid 150 is used to push fish 200 toward the bottom of the screen 140. Also, in FIG. 9, it can bee seen how first crimp 260 and second crimp 262 and third crimp 264 may be provided for stiffening the submersion lid 150. FIG. 3 is similar to FIGS. 7 and 8, providing a perspective view as when the submersion lids 150 are used to push fish 200 toward the bottom of the screens 140 and 144.

As noted above, FIGS. 11, 13, 14, and 15 are provided to show bleed tanks, used to bleed freshly caught fish before placing them into the refrigerated brine for freezing. The bleed tanks may be located along the outer perimeter of the submersion tank 110, as better seen in FIGS. 11 and 15.

FIG. 7 shows freshly caught fish which have just been bled in just mentioned bleed tanks being placed into one of the pivotable screens 140 and 144 to start the whole fish freezing process. FIG. 8 shows one of the pivotable screens 140 substantially filled with fish, and showing the use of the submersion lid 150 to push fish downward into the refrigerated, freezing brine 220, which is helpful since fish tend to float in the highly concentrated freezing brine.

FIG. 10 illustrates the pivotable screen being pivoted at the pivot points on the port side of the submersion tank 110, to raise the starboard, distal end of the screen toward an upper, fish discharge position for screen 140, in which the frozen whole fish are discharged from the screen 140 as it is tilted upward toward its upward, fully open, fish discharge position. Also shown is the bin 210 full of fresh frozen whole fish, wherefrom the fish 213 are removed and may be bagged in bags 212, and sent down chute 214 into the vessel 109's refrigerated hold for storage.

Figure 9:
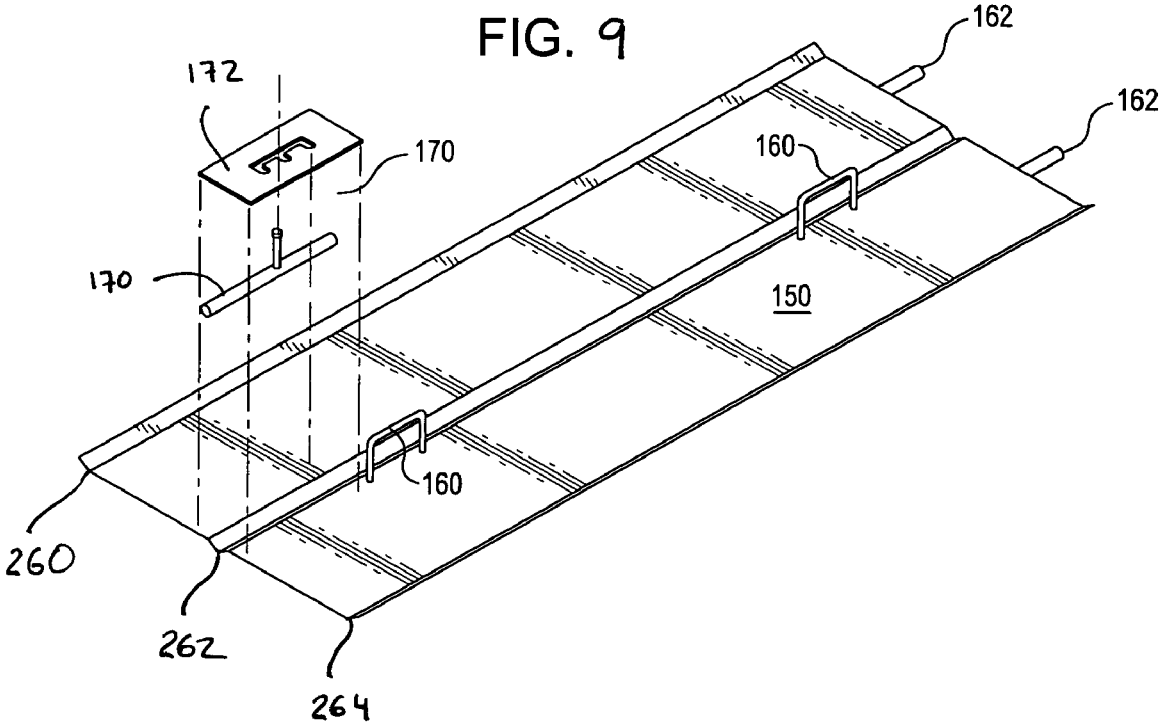
FIG. 9 is a perspective view of details of a submersion lid for use in urging fish downward into refrigerated brine located in a pivotable caged screen basket.
Figure 13:
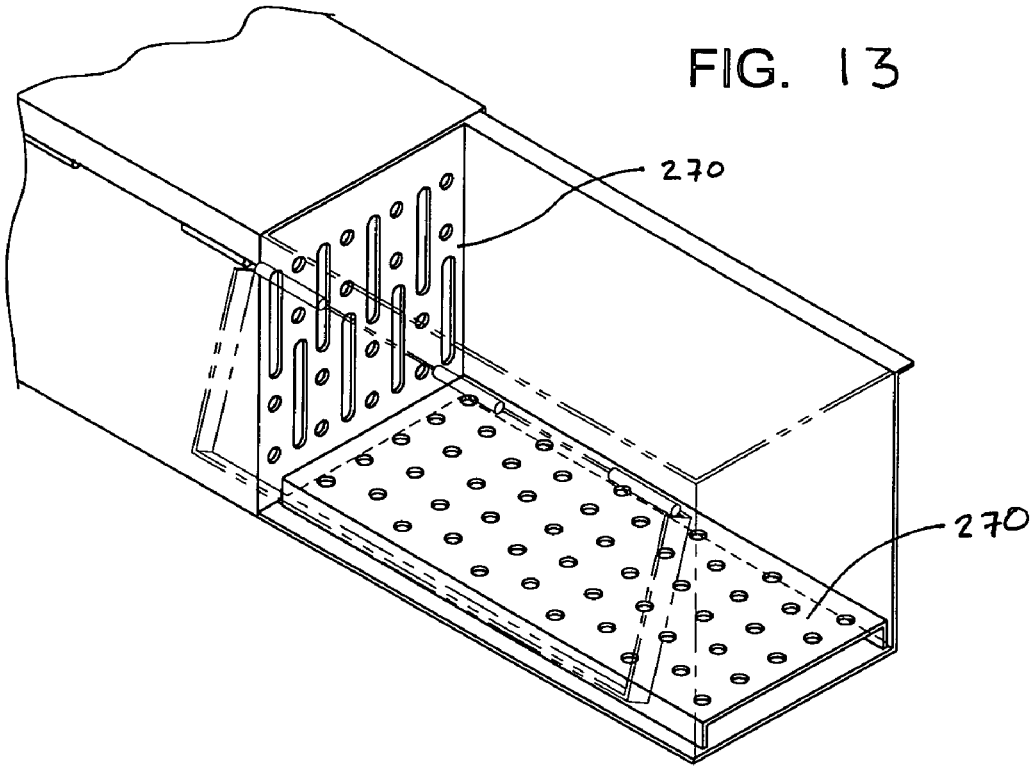
FIG. 13 provides details of one view of the holding tank for handling freshly caught fish.
Figure 14:
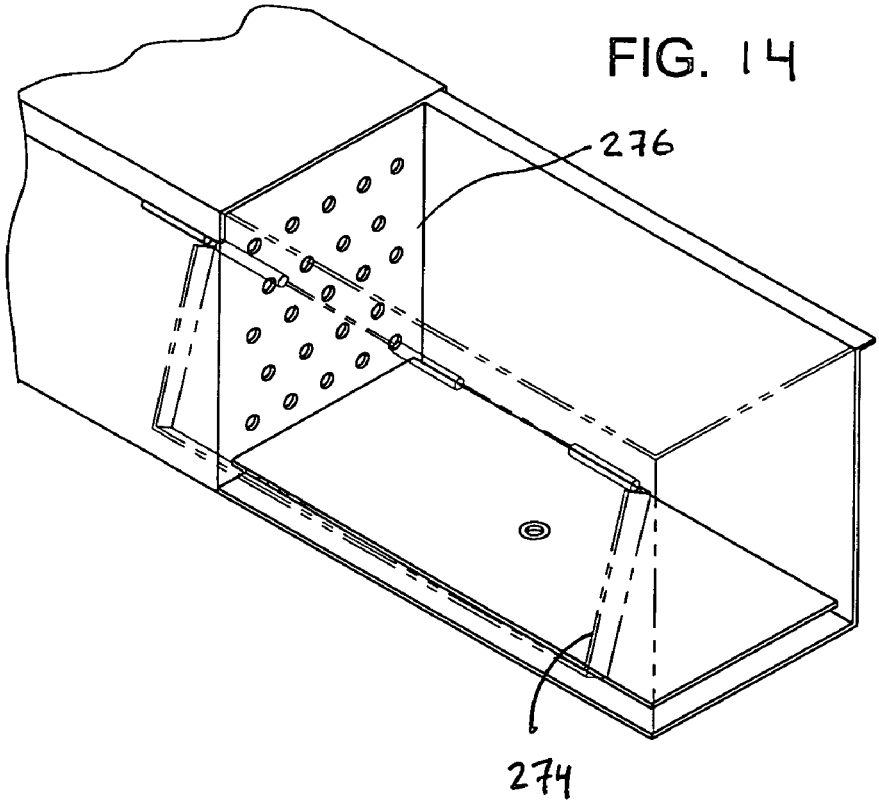
FIG. 14 provides details of another portion of the holding tank for handling freshly caught fish.

Although FIG. 9 illustrates one embodiment suitable for the size and shape of a manual submersion lid 150, it should be recognized that the submersion lid 150 size must be sized and shaped for complementary mating engagement with respect to the interior upwardly projected open space in a selected pivotable screen 140 and 144, whatever the exact size and shape provided. As illustrated, it may be advantageous to provide a generally U-shaped bleed tank system surrounding port, stern, and starboard sides of the submersion tank 110. Separate compartments as illustrated in FIGS. 13 and 14 may be provided in the bleed tanks, so that freshly caught fish may be placed in one part of the bleed tank system, and fully bled fish moved to another portion of the bleed tank system, in preparation for freezing. As shown in FIG. 13, a slotted bleed screen 270 may be provided to allow water flow, and a perforated floor 272 may be provide, with hinged wall portion 274 to assist in pushing fish along. Also, as seen in FIG. 14, a perforated bleed screen 276 may be provided.

Although only several exemplary embodiments of these development(s) have been described in detail, it will be readily apparent to those skilled in the art that the novel on-board fish freezing equipment, and methods for freezing of fish utilizing the equipment, may be modified from the exact embodiments provided herein, without materially departing from the novel teachings and advantages provided by this invention, and may be embodied in other specific forms without departing from the spirit or essential characteristics thereof. Therefore, the disclosures presented herein are to be considered in all respects as illustrative and not restrictive. It will thus be seen that the objects set forth above, including those made apparent from the preceding description, are efficiently attained. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise forms disclosed.

All of the features disclosed in this specification (including any accompanying claims, and the drawing) may be combined in any combination, except combinations where at least some of the features are mutually exclusive. Alternative features serving the same or similar purpose may replace each feature disclosed in this specification (including any accompanying claims, and the drawing), unless expressly stated otherwise. Thus, each feature disclosed is only one example of a generic series of equivalent or similar features. Further, while certain process steps are described for the purpose of enabling the reader to make and use certain apparatus in a method of on-board freezing of fish, such suggestions shall not serve in any way to limit the claims to the exact variation disclosed, and it is to be understood that other variations may be advantageously utilized.

The intention is to cover all modifications, equivalents, and alternatives falling within the scope and spirit of the invention, as expressed herein above and in any of the appended claims. The scope of the invention, as described herein and as indicated by any of the appended claims, is thus intended to include variations from the embodiments provided which are nevertheless described by the broad meaning and range properly afforded to the language of the claims, as explained by and in light of the terms included herein, or the legal equivalents thereof.

The invention claimed is:

1. A tank system for freezing of fish with refrigerated brine, said tank system comprising:

(a) a liquid container, said liquid container comprising a bottom, upwardly extending sidewalls ending at an upper end portion;

(b) one or more brine inlet headers for supply of refrigerated brine, at least one of said one or more brine inlet headers extending peripherally around said liquid container, and in fluid communication with at least one of said one or more brine inlet headers, one or more liquid distributor inlets for supply of refrigerated brine from one of said brine inlet headers into said liquid container, said liquid distributor inlets spaced apart around the interior of said liquid container;

(c) one or more liquid outlets for accepting brine to be discharged from said liquid container, and in fluid communication with said one or more liquid outlets, a brine outlet header for accepting brine to be discharged from said liquid container;

(d) said liquid container having an upwardly extending above deck portion and a downwardly extending below deck portion.

2. The tank system as set forth in claim 1, further comprising a cover, said cover adapted for detachable secured engagement with said upper end portion of said liquid container.

3. The tank system as set forth in claim 2, wherein said cover comprises a first portion and a second portion, and wherein said first and second portions are hingedly joined for independent movement of said first portion or of said second portion.

4. The tank system as set forth in claim 3, wherein said cover comprises a perimeter portion sized and shaped with respect to said upper end portion of said liquid container so that said upper end portion and said perimeter portion may be clamped together in secure mating engagement, so as to close said liquid container.

5. The tank system as set forth in claim 3, wherein said first and said second portions are substantially rectangular in shape.

6. The tank system as set forth in claim 1, further comprising one or more pivotable screen baskets, each of said pivotable screen baskets sized and shaped for pivotable movement by an angle alpha between a lowered, normal, fish loading position, and a upward, fish unloading position.

7. The tank system as set forth in claim 6, wherein said pivotable screen baskets each comprise a pair of spaced apart pivot ears, and wherein said liquid container further comprises at least two pairs of pivot supports located along said upper end portion of said sidewalls of said liquid container, and wherein said pivot ears are each joined by pivot pins to said pivot supports for pivotable motion of said pivotable screen baskets.

8. The tank system as set forth in claim 6, wherein said pivotable screen baskets each comprise a generally rectangular opening defined by edgewall portions;

a downwardly extending compartment sized and shaped for receiving fish therein, said downwardly extending compartment having opposing sidewalls, a first endwall, and a second endwall;

at least one of said opposing sidewalls, first endwall, and second endwall of said at least one pivotable screen basket comprising apertures therein defined by edgwall portions, said apertures adapted for allowing escape of said liquid therethrough while preventing fish from escaping therethrough; and wherein each of said pivotable screen baskets is sized and displaceably located for filling and for emptying by pivotable movement with respect to said liquid container.

9. The tank system as set forth in claim 8, wherein each one of said pivotable screen baskets is provided in a generally pie piece shape comprising an arcuate cylindrical slice.

10. An apparatus for freezing fish on-board a fishing vessel, said apparatus comprising:

(a) a tank, said tank comprising a bottom and an upwardly extending sidewall having an upper end portion, said tank sized, shaped, and insulated for containing a refrigerated brine therein;

(b) at least one caged screen basket, said caged screen basket comprising (i) an upper opening defined by edgewall portions, (i) a downwardly extending compartment sized and shaped for receiving fish therein, said compartment having opposing sidewalls, a first endwall, and a second endwall, (iii) at least one said opposing sidewalls, first endwall, and second endwall of said at least one caged screen basket comprising apertures therein defined by edgewall portions, said apertures adapted for allowing escape of said liquid therethrough while preventing fish from escaping there through;

(c) said at least one caged screen basket sized and displaceably located for filling and for emptying by pivotable movement with respect to said tank, said at least one caged screen basket attached by a pivot connection to said upper end portion of said upwardly extending sidewall, said at least one caged screen basket pivotally connected for repetitive movement between a downward, at-rest, fish freezing position and an upward, fish removal position for harvest of fish from said at least one caged screen basket.

11. The apparatus as set forth in claim 10, further comprising (a) one or more brine inlet headers for supply of refrigerated brine, at least one of said one or more brine inlet headers extending peripherally around said tank, and in fluid communication with at least one of said one or more brine inlet headers, one or more liquid distributor inlets for supply of refrigerated brine from one of said brine inlet headers into said tank, said liquid distributor inlets spaced apart around the interior of said tank, and (b) one or more liquid outlets for accepting brine to be discharged from said tank, and in fluid communication with said one or more liquid outlets, a brine outlet header for accepting brine to be discharged from said tank.

12. The apparatus as set forth in claim 11, wherein said one or more liquid distributor inlets is sized and shaped for fluid communication at each side of said upper opening of each of said one or more screen baskets.

13. The apparatus as set forth in claim 12, wherein said upper opening of each one of said pivotable screen baskets is generally rectangular in shape, and wherein said brine inlet headers are sized and shaped to closely fit around the outer edge of each of said upper openings of each one of said pivotable screen baskets.

14. The apparatus as set forth in claim 13, wherein said brine inlet headers are provided in a figure 8 shape in said tank.

15. The apparatus as set forth in claim 12, wherein said tank comprises a an upwardly extending above deck portion and a downwardly extending below deck portion.

16. The apparatus as set forth in claim 12, further comprising at least one vertical baffle portion, said at least one vertical baffle portion located between a first and a second pivotable screen basket, so that said vertical baffle portion substantially prevents flow of refrigerated brine around the side of a pivotable screen basket.

17. The apparatus as set forth in claim 12, further comprising at least one arcuate baffle portion, said arcuate baffle portion sized and shaped for closely engaging an arcuate bottom portion of one of said pivotable screen baskets, so that said arcuate baffle portion substantially prevents flow of refrigerated brine around the bottom of a pivotable screen basket.

18. The apparatus as set forth in claim 12, wherein said apparatus comprises at least two pivotable screen baskets.

19. The combination of a fishing vessel and an apparatus for freezing fish on-board a fishing vessel, said combination comprising:

(a) a fishing vessel;

(b) a tank, said tank comprising a bottom and an upwardly extending sidewall having an upper end portion, said tank sized, shaped, and insulated for containing a refrigerated brine therein;

(c) at least one caged screen basket, said caged screen basket comprising (i) an upper opening defined by edgewall portions, (i) a downwardly extending compartment sized and shaped for receiving fish therein, said compartment having opposing sidewalls, a first endwall, and a second endwall, (iii) at least one said opposing sidewalls, first endwall, and second endwall of said at least one caged screen basket comprising apertures therein defined by edgewall portions, said apertures adapted for allowing escape of said liquid therethrough while preventing fish from escaping there through;

(d) said at least one caged screen basket sized and displaceably located for filling and for emptying by pivotable movement with respect to said tank, said at least one caged screen basket attached by a pivot connection to said upper end portion of said upwardly extending sidewall, said at least one caged screen basket pivotally connected for repetitive movement between a downward, at-rest, fish freezing position and an upward, fish removal position for harvest of fish from said at least one caged screen basket.

20. The combination as set forth in claim 19, further comprising at least one vertical baffle portion, said at least one vertical baffle portion located between a first and a second pivotable screen basket, so that said vertical baffle portion substantially prevents flow of refrigerated brine around the side of a pivotable screen basket.

21. The combination as set forth in claim 19, further comprising at least one arcuate baffle portion, said arcuate baffle portion sized and shaped for closely engaging an arcuate bottom portion of one of said pivotable screen baskets, so that said arcuate baffle portion substantially prevents flow of refrigerated brine around the bottom of a pivotable screen basket.

22. The combination as set forth in claim 19, wherein said apparatus comprises at least two pivotable screen baskets.

23. The apparatus as set forth in claim 7, wherein said pivotable screen baskets further comprise one or more stiffeners, said stiffeners running generally radially outward from said pivot ear, and spaced apart an angle beta.

24. The apparatus as set forth in claim 23, wherein said angle beta is approximately 30 degrees.

25. The apparatus as set forth in claim 23, wherein said stiffeners comprise half-round structural portions.

26. The apparatus as set forth in claim 7, wherein said generally rectangular openings comprise half round structural portions.

27. The apparatus as set forth in claim 1, wherein said brine liquid inlet headers comprise square tubular fluid conducting structures.

28. The apparatus as set forth in claim 8, further comprising a submersion lid for each one of said one or more pivotable screen baskets, said submersion lids comprising a stiff planar sheet having locating pins at a first end, and a displaceable, latchable pin at a second end, said submersion lid adapted for manual entry through said generally rectangular opening of said one or more pivotable screen baskets.

29. The apparatus as set forth in claim 28, wherein said submersion lid comprises a generally rectangular plate, said generally rectangular plate further comprising one or more strengthing ridges therein.

30. The apparatus as set forth in claim 28, wherein said submersion lid comprises at least one generally U-shaped handle.

31. A method for on-board freezing of fish, comprising providing a refrigerated brine filed tank, said brine cooled to 20F or lees, providing one or more pivotable screen baskets which are pivotably immersable in, and removable from, said refrigerated brine in said brine filled tank;

filling at least one of said pivotable screen baskets with fish to be frozen while said pivotable screen baskets are in a lowered, fish freezing position;

retaining said fish to be frozen in said pivotable screen baskets until said fish are frozen; removing said fish from said refrigerated brine by pivoting said at least one pivotable screen basket upward to a fish unloading position;

removing said fish from said at least one pivotable screen basket.

32. The method as set forth in claim 31, further comprising bleeding fish to be frozen before filling said one or more pivotable baskets with said fish to be frozen.

33. The method as set forth in claim 32, further comprising, after removing said fish from said pivotable screen basket, individually bagging fish after freezing said fish to provide individually bagged fish, and then placing said individually bagged fish in a refrigerated hold.

* * * * *